US005605281A

United States Patent [19]

Benenowski et al.

[11] Patent Number: 5,605,281

[45] Date of Patent: Feb. 25, 1997

[54] RAIL SUPPORT SYSTEM

[75] Inventors: Sebastian Benenowski; Hubertus Höhne, both of Butzbach; Alfred Kais, Lich-Eberstadt; Erich Nuding, Aalen, all of Germany

[73] Assignee: BWG Butzbacher Weichenbau, GmbH, Butzbach, Germany

[21] Appl. No.: 424,505

[22] PCT Filed: Nov. 24, 1993

[86] PCT No.: PCT/EP93/03297

§ 371 Date: Jun. 15, 1995

§ 102(e) Date: Jun. 15, 1995

[87] PCT Pub. No.: WO94/12729

PCT Pub. Date: Jun. 9, 1994

[30] Foreign Application Priority Data

Nov. 27, 1992 [DE] Germany ..... 42 39 878.9

[51] Int. Cl.[6] ..... E01B 3/00

[52] U.S. Cl. ..... 238/26; 238/1; 238/2; 238/121; 104/124

[58] Field of Search ..... 104/124, 123, 104/126; 238/1, 2, 24, 26, 27, 121, 29, 12

[56] References Cited

U.S. PATENT DOCUMENTS

| | | | |
|---|---|---|---|
| 429,470 | 6/1890 | McGiehan | 105/124 |
| 564,854 | 7/1896 | Toal | 104/124 |
| 999,644 | 8/1911 | Gooch | 238/26 |
| 1,232,191 | 7/1917 | Bohannan | 238/26 |
| 2,153,624 | 4/1939 | Jones | 238/24 |
| 2,669,394 | 2/1954 | Poebing | 238/24 |
| 2,708,072 | 5/1955 | Dalton | 238/24 |

*Primary Examiner*—Mark T. Le
*Attorney, Agent, or Firm*—Dennison, Meserole, Pollack & Scheiner

[57] ABSTRACT

A support system for a rail section which bridges the gap between foundations which are relatively movable auxiliary rails running parallel to the rail across the sleepers which are supported by the foundation, and underpinning supports providing a stiff connection between rail and auxiliary rails. The underpinning supports move in response to relative movement of the foundation so that undesirable rail bending is avoided.

12 Claims, 4 Drawing Sheets

RAIL SUPPORT SYSTEM

BACKGROUND OF THE INVENTION

The invention relates to a support system for a rail between two foundations including sleepers moveable relative to one another and for fixing said rail, in particular for a rail section of an expansion joint in the area of a bridge joint.

Expansion joints are used to permit relative movement between structure and track, in an area of a track superstructure, for example in the vicinity of bridges. These expansion joints comprise tongue and stock rail that are moveable relative to one another. To this end, a tongue can be fixed between the stock rail at one side and a clamping jaw can be stationarily disposed on the opposite side.

In the area of the joint, support of the rail often absent, so that when the joint is relatively wide undesirable bending of the rail results when the track is traversed.

OBJECTS OF THE INVENTION

The object underlying the present invention is to further develop a support system for a stock rail and for fixing the rail between foundations including sleepers where the foundations are moveable relative to one another, in particular for a rail section of an expansion joint in the vicinity of a bridge joint. To avoid undesired bending of the stock rail, so that track-like conditions prevail in the area between the foundations which are moveable relative to one another. In addition, an equalization of the support should be achieved by simple design means, regardless of the size of the distance between the foundations.

The problem is substantially solved in accordance with the invention in that supporting elements extending from the foundation run parallel to the stock rail and on both sides thereof, so that at least one support element which runs along the stock rail is designed to be moveable in the longitudinal direction which is defined by the supporting elements and the stock rail.

SUMMARY OF THE INVENTION

The purpose of the invention is the prevention of rail bending which can occur in the area between foundations which are moveable relative to one another, and in particular in the area of a bridge joint. In accordance with the invention, the stock rail is underpinned by braces of preferably plate-like design such that when the stock rail is traversed no undesirable bending occurs. To this end, the plate-like braces are held in position by supporting elements, preferably in the form of supporting rails, designated as auxiliary rails, which in their turn are fixed on railroad ties such as sleepers on which the stock rail is supported.

The result is practically a stiffening of the stock rail in the area of the bridge joint as a result of the fact that the rail foot of the stock rests on at least one support plate which in turn extends from supporting rails arranged on both sides of the stock rail and in its longitudinal direction.

At least two plate-like supports or braces are preferably provided which are designed relatively moveable both to the stock rail, the supporting rails and to one another. The result is a movement along the supporting rails and the stock rail such that an equalization of the distances between rail supports is achieved in the area of the bridge joint. To that end, drivers or limiters in the form of cams or shears extend from the auxiliary rails or rail on the one hand, and from the support(s) on the other hand. The cams or shears move or fix the supports during movement of the supporting rails and the stock rail depending on their position.

In a further embodiment of the invention, the supporting elements such as supporting rails are connected stationarily with one of the foundations such as sleepers which are moveable relative to one another, such that a displacement relative to the other foundation can take place in the event of a relative movement between structure and track. By contrast, the stock rail is more firmly connected to that foundation with which the supporting rail is not stationarily connected than to the other foundation.

Further details, advantages and features of the invention are clear not only from the claims and from the features they describe, singly and/or in combination, but also from the following description of a preferred embodiment shown in the drawing.

BRIEF DESCRIPTION OF THE DRAWINGS

In FIGS. 1 to 3, in which identical elements are identically numbered, sections of a track in the area of bridge joints (10, (12) and (14) are shown. The differing widths are the result of foundation movement.

Figure 1:
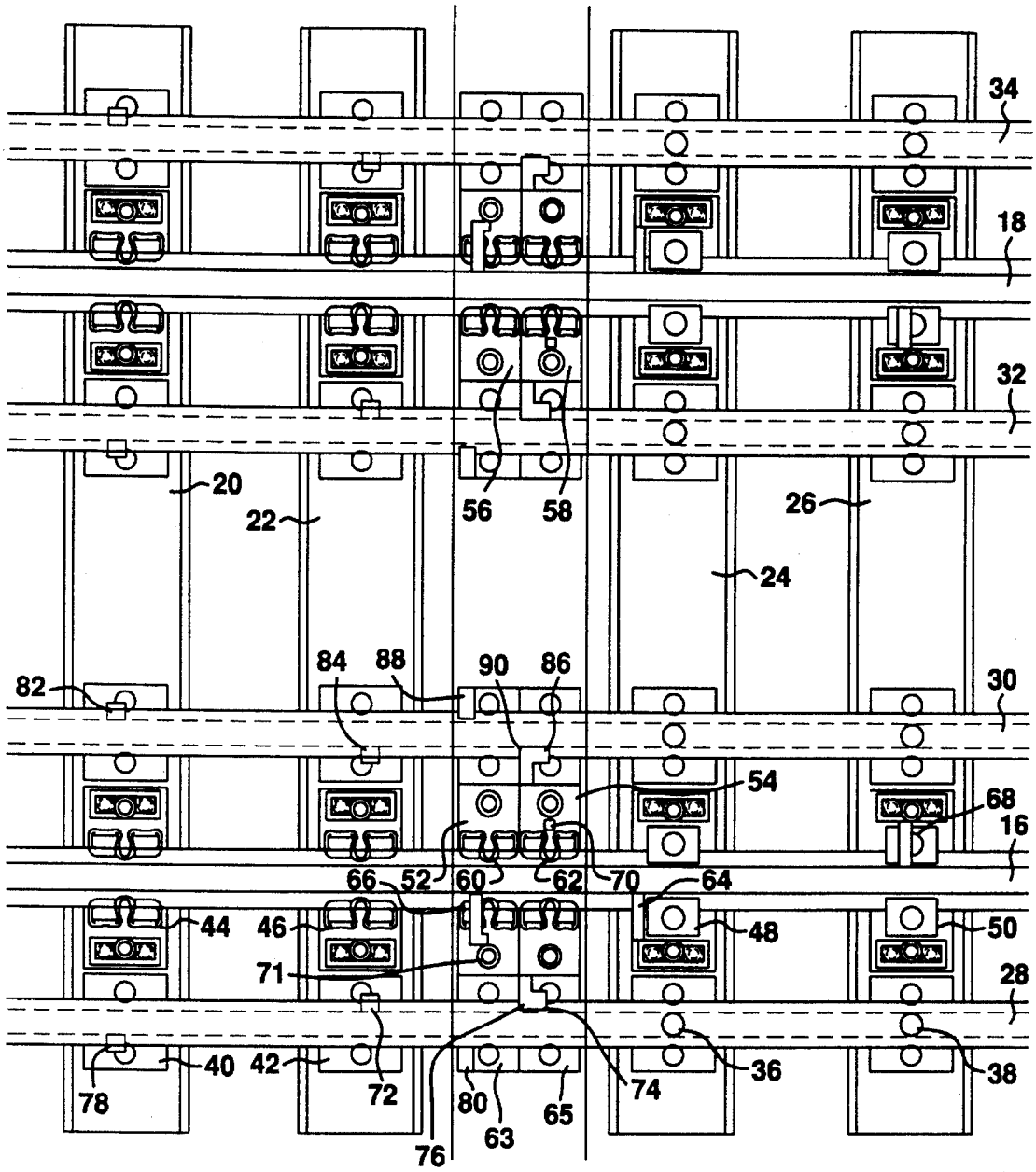
FIG. 1 shows track section in the area of a bridge joint.

The track section comprises stock rails (16), (18) supported on sleepers (20), (22), (24) and (26) such as railroad ties, which in turn are supported by foundations (22', 24').

The sleepers (20) and (22) are moveable relative to the sleepers (24) and (26), which are fastened to a structure such as a bridge, for example. The rails (16) and (18) extend into an expansion joint of known type, which in the embodiment shown, is on the right side.

The foundations (22', 24') and thus the expansion joint comprise a stock rail and a tongue that are moveable relative to one another.

In order to support the rails (16) and (18) in the area of the bridge joint (10), (12) or (14), the design set forth below is proposed in accordance with the invention.

Parallel to the stock rails (16) and (18) are auxiliary or supporting rails (28), (30), or (32) and (34), which also extends across the sleepers (20), (22) or (24), (26) respectively. The supporting rails (28), (30), (32) and (34) are fixedly connected to the sleepers (24) and (26) by clamping plates (creep preventers), two of which are numbered (36) and (38) by way of example. On the other sleepers (20) and (22) moveable relative to the sleepers (24) and (26), the supporting rails (28) and (30) are connected using sliding type clamping plates, in order to permit a movement relative to the sleepers (20) and (22). Two sliding clamping plates are numbered (40) and (42) by way of example.

The stock rails (16) and (18) are in turn fixed on the sleepers (20) and (22) using conventional clamps (44) and (46) that permit only a slight relative movement between the rail (16) or (18) and the sleepers (20) and (22). By contrast, the stock rails (16) and (18) are less firmly connected to the sleepers (24) and (26), by means of clamping plates (48) and (50) permitting a relative movement between the rail (16) and (18) and the sleepers (24) and (26).

Plate-like braces (52), (54) and (56, (58), underpinning the stock rails (16) and (18) on the underside and supporting them at the same time, extend from the supporting rails (28), (30) or (32), (34) perpendicular to the longitudinal direction defined by the stock rails. Further, there is a connection between the braces (52), (54) (56), (58) and the rails (16), (18) using tightening clamps two of which are numbered (60), (62), by way of example.

To permit only a relative movement along the rails (16) and (18), but also along the supporting rails (28), (30), (32) and (34), a connection is made to the plate-like braces using sliding clamping plates (63), (65) corresponding to the sliding clamping plates (40) and (42).

The above described connections between the braces (52), (54), (56), (58) and the stock rails (16), (18) and the supporting rails (28), (30), (32), (34) ensure that the stock rails (16), (18) in the area of the bridge joint (10) or (12) or (14) are held in position to the necessary extent, so that undesirable or unacceptable bending is avoided when rolling stock crosses them.

Figure 2:
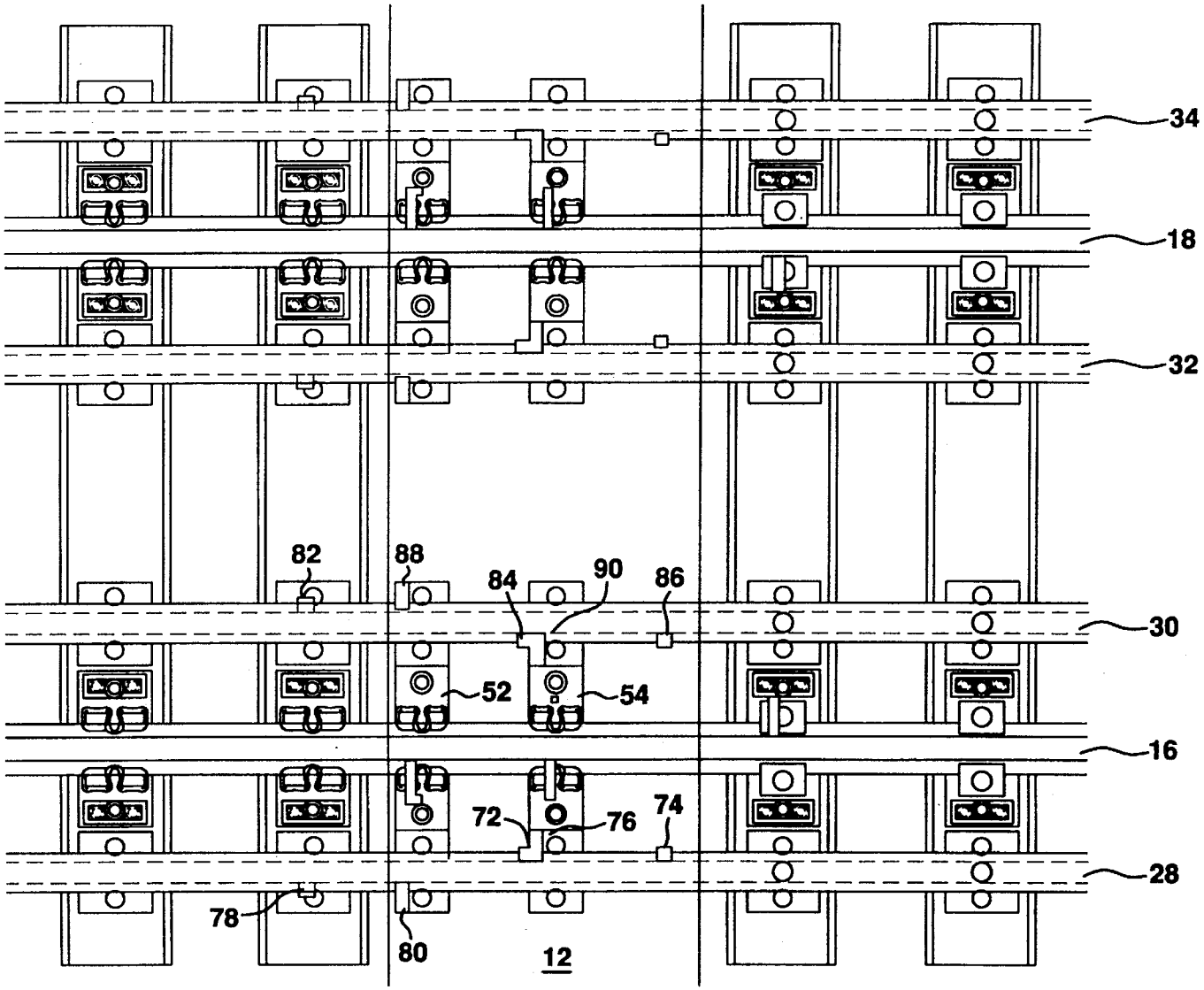
FIG. 2 shows the track section according to FIG. 1, but with a wider bridge joint.
Figure 3:
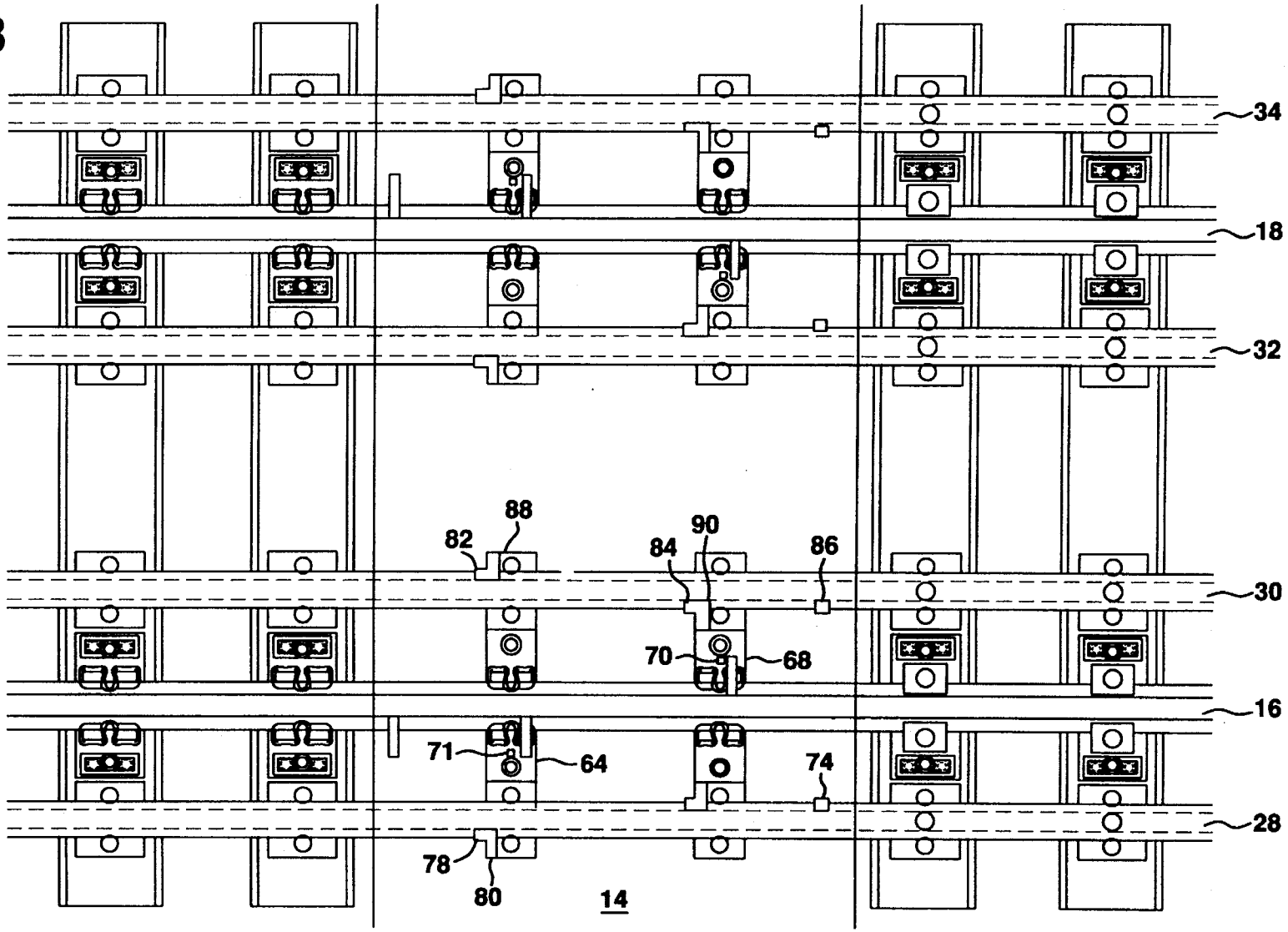
FIG. 3 shows the track section according to FIG. 1 and FIG. 2, but with an even wider bridge joint.

In order to permit an even support of the rails (16) and (18) regardless of the width of the bridge joint (10), (12) or (14), the braces (52), (54), (56), (58) are moveable, as already mentioned, relative both to the stock rails (16) and (18) and to the supporting rails (28), (30), and (32), (34). The result is a selective movement of the braces (52), (54), (56) and (58) as a function of the width of the bridge joint (10), (12) or (14) such that the distances between the braces are equalized. To ensure this, either drivers and limiters or alternatively, shears are provided. In accordance with FIGS. 1 to 3, the drivers and limiters extend both from the braces (52), (54), (56) and (58) and from the stock rails (16) and (18) and supporting rails (28), (30), (32) and (34).

The arrangement of the braces (52), (54) and of the rails (16), (28), (30), the allocations of the drivers and limiters designed as cams, and the resultant displacement of the plate-like braces (52), (54) along the stock rail (16) and auxiliary rails (28), (30) are made clear from inspection of the figures.

Cams (64) and (66) therefore extend from one side of the stock rail (16), and a cam (68) from the opposite side. A cam (71) running between the cams (64) and (66) of the stock rail (16) extends from the support (52). A cam (70) extending from the brace (54) is allocated to the cam (68).

Consequently, the brace (54) can move relative to the stock rail (16) at most between the brace (52) and the cam (68).

Cams (72) and (74) extend from the side of the supporting rail (28) facing the stock rail (16), to which cams is allocated a cam (76) extending from the brace (54). The cam (76) is accordingly between the cams (72) and (74) of the supporting rail (28). On the outside, the supporting rail (28) has a cam (78) to which is allocated a cam (80) of the brace (52).

Appropriate drivers or limiters—disposed in mirror-symmetrical form—are on the supporting rail (30), i.e. an external cam (82) and two internal cams (84) and (86), to which are allocate cams (88) and (90) of the braces (52) and (54).

If the sleepers (24) and (26) are now moved to the right (FIG. 2), thus widening the bridge joint (bridge joint (12)), the cams (72) and (84) of the supporting rails (28) and (30) engage with the cams (76) and (90) of the braces (52) and (54) such that the brace (54) is drawn to the right. If the bridge joint (bridge joint (14)) is widened still further, the cams (80) and (88) are also engaged by the outside cams (78) and (82) of the supporting rails (28) and (30), so that there is also a movement along the stock rail (16). As a result, a uniform support of the stock rail (16) in the area of the bridge joint (14) is achieved.

If the bridge joint now narrows, the cams (74) and (86) of the supporting rails (28) and (30) engage with the cams (70) and (76) of the brace (54), so that these cams are moved in the direction of the fixed sleepers (20) and (22).

The cams (64), (66) and (68) extending from the rail (16) and their allocated cams (70) and (71) projecting from the braces (52) and (54) are intended to ensure that the brace (52) and (54) cannot creep or move in an uncontrolled manner in the event that they have come loose. The cams (64), (68) can be provided with a shock-absorbing elements such as a spring element in order to absorb displacements of the braces (52) (54) when the movements are greater than intended, without the cams (64), (68) and (71) being destroyed.

Figure 4:
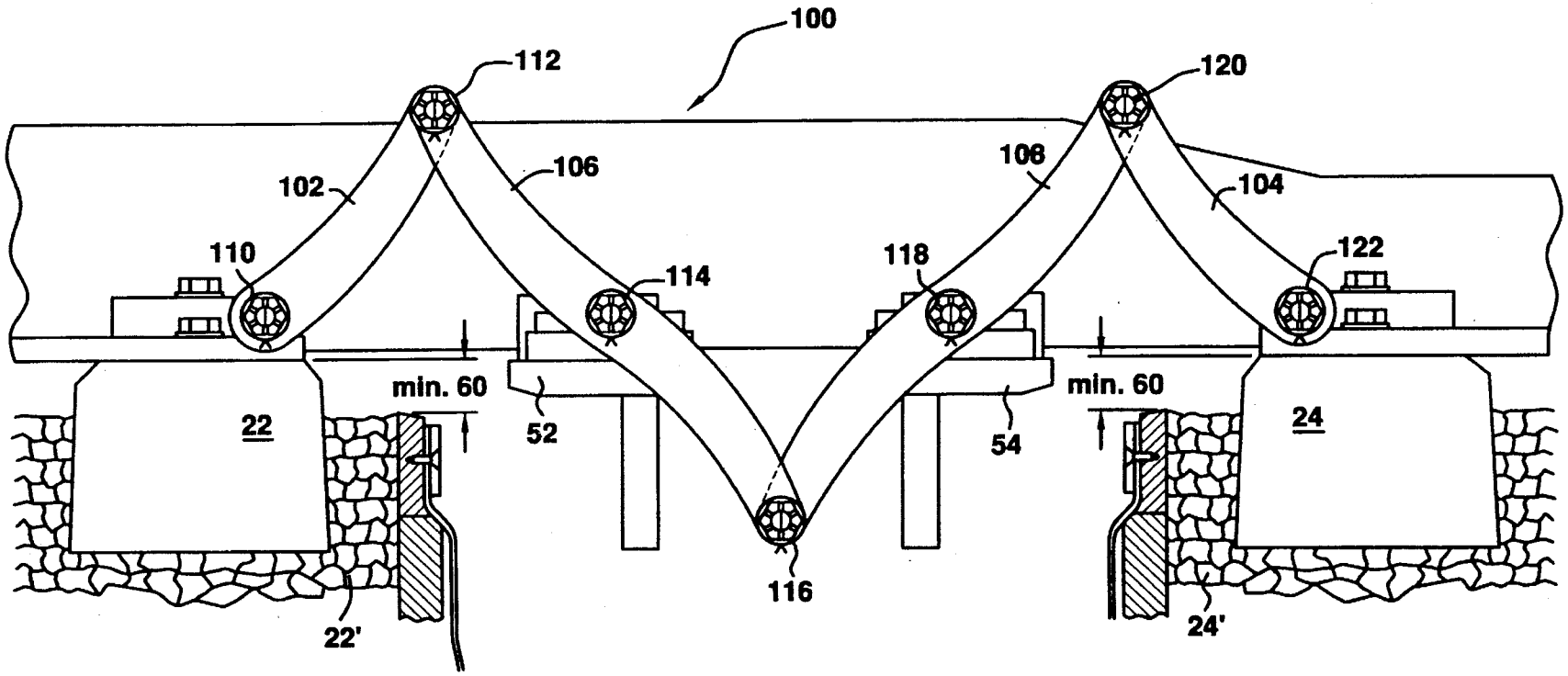
FIG. 4 shows an embodiment for equalization of the distances between supports and sleepers.

An optional arrangement for equalization of the distances between rail fastening points such as sleepers (22) and (24) and the braces (52) and (54) between and parallel to these is shown in FIG. 4. Here, the sleepers (22), (24) and the braces (52) and (54) are connected to one another by shears (100), the outer legs (102) and (104) of which are pivotally connected to inner legs (106) and (108) which are pivotally attached in their centers to the braces (52) and (54) respectively. The pivotal or fastening or adjusting points (110), (112), (114), (116), (118), (120) and (122) run between the legs (102), (104), (106) and (108) or equidistantly to one another from the sleepers (22), (24) and braces (52), (54).

We claim:

1. A support system for a stock rail extending in a longitudinal direction between foundations which are separated by a variable distance and thus moveable relative to one another while holding said stock rail in position, comprising:

supporting elements extending across said foundations and arranged to run parallel to both sides of said stock rail; and said supporting elements including at least one means underpinning said stock rail, said underpinning means being moveable in the longitudinal direction of the stock rail and the supporting elements.

2. A support system according to claim 1, wherein said underpinning means includes a first and a second plate-like brace arranged between the foundations; and limiting means operating so that changes of distance between said plate-like braces and between said foundations is adjustable, said limiting means cooperating with said stock rail, said supporting elements and said plate-like braces.

3. A support system according to claim 2, wherein said supporting elements are in the form of auxiliary rails which are fixedly connected to only one of said foundations and slidably connected to the other of said foundations.

4. A support system according to claim 3, wherein said plate-like braces are moved in the longitudinal direction of the stock rail, the distance of movement being a function of the distance between the foundations.

5. A support system according to claim 2, wherein the foundations include sleepers, the stock rail is connected by sliding clamps to the sleepers, and said supporting elements are connected by creep-preventing clamping plates to the sleepers.

6. A support system according to claim 2, wherein said limiting means includes first and second cams extending from one side of the stock rail, a third cam extending from the other side of the stock rail, a fourth cam extending from the first brace and positioned between the first and second cams, said fourth cam extends from the first brace and a fifth cam which extends from the second brace so as to cooperate with the third cam, said limiting means operating so that the second brace and fifth cam move relative to the stock rail only between the first brace and the third cam.

7. A support system according to claim 2, wherein said limiting means operates to equalize the distances between the foundations and the plate-like braces, and includes outer legs pivotally connected to the foundations, inner legs pivotally connected to the plate-like braces and said inner and outer legs are pivotally connected to each other.

8. For an expansion joint in the area of a bridge, a support system for stock rails laid across a fixed foundation and a movable foundation separated by a variable distance, said stock rail extending in a longitudinal direction being held in position by sleepers which are fixed to foundations, the support system comprising:

a pair of auxiliary rails extending across the sleepers, each of the auxiliary rails running parallel to a side of the stock rail in said longitudinal direction, means underpinning the stock rails extending between the auxiliary rails and perpendicular to the longitudinal direction, said means including braces and clamps for tightening the auxiliary rails to the braces, and equalizing means for moving the underpinning means in the longitudinal direction as a function of the distance which separates the foundations.

9. A support system according to claim 8, wherein said pair of auxiliary rails are fixedly connected to one of the sleepers and slidably connected to the other sleeper.

10. A support system according to claim 9, wherein said braces include a first and a second brace each in form of a plate, said plates connected to the stock rail and to the auxiliary rails by clamps, so as to prevent undesired bending of the stock rail under wheel load.

11. A support system according to claim 10, wherein said equalizing means includes a plurality of cams and projections extending from the stock rails and the plates, to cause movement of the underpinning means so that the distances between one said foundation and one said brace as well as between the first and second braces are substantially equal.

12. A support system according to claim 10, wherein said equalizing means includes a plurality of pivotable components which connect the sleepers with the underpinning means so that the distances between one said foundation and one said brace as well as between the first and second braces are substantially equal.

* * * * *